US010851512B2

(12) United States Patent
Ruiz Teran et al.

(10) Patent No.: US 10,851,512 B2
(45) Date of Patent: Dec. 1, 2020

(54) FOUNDATION PILE, A GROUTING METHOD FOR THE SAID PILE AND A MANUFACTURING METHOD THEREFOR

(71) Applicants: FERROVIAL AGROMAN, S.A., Madrid (ES); GRUPO RODIO KRONSA, S.L., Madrid (ES)

(72) Inventors: Pablo Ruiz Teran, Madrid (ES); Jose Luis Arcos Alvarez, Madrid (ES); Rafael Gil Lablanca, Madrid (ES); Carlos Cano Barreiro, Madrid (ES)

(73) Assignees: FERROVIAL AGROMAN, S.A., Madrid (ES); GRUPO RODIO KRONSA, S.L., Madrid (ES)

( * ) Notice: Subject to any disclaimer, the term of this patent is extended or adjusted under 35 U.S.C. 154(b) by 0 days.

(21) Appl. No.: 15/544,801

(22) PCT Filed: Jan. 22, 2016

(86) PCT No.: PCT/ES2016/070033
§ 371 (c)(1),
(2) Date: Jul. 19, 2017

(87) PCT Pub. No.: WO2016/116653
PCT Pub. Date: Jul. 28, 2016

(65) Prior Publication Data

US 2018/0010314 A1 Jan. 11, 2018

(30) Foreign Application Priority Data

Jan. 23, 2015 (ES) ..... 201530091

(51) Int. Cl.
*E02D 5/30* (2006.01)
*E02D 5/52* (2006.01)
(Continued)

(52) U.S. Cl.
CPC ..... *E02D 5/30* (2013.01); *E02D 5/24* (2013.01); *E02D 5/523* (2013.01); *E02D 5/62* (2013.01);
(Continued)

(58) Field of Classification Search
CPC .. E02D 5/24; E02D 5/30; E02D 5/523; E02D 5/62; E02D 5/32
See application file for complete search history.

(56) References Cited

U.S. PATENT DOCUMENTS 958,967 A * 5/1910 Mohun ..... E02D 5/30 405/257
1,163,377 A * 12/1915 Selfridge ..... E02D 5/30 405/257
(Continued)

FOREIGN PATENT DOCUMENTS

| | | |
|---|---|---|
| DE | 2015687 | 10/1971 |
| FR | 501464 | 4/1920 |
| GB | 191210196 | 7/1912 |

OTHER PUBLICATIONS

International Search Report for Application No. PCT/ES2016/070033, dated Jun. 7, 2016.
(Continued)

*Primary Examiner* — Tara Mayo-Pinnock
(74) *Attorney, Agent, or Firm* — Squire Patton Boggs (US) LLP

(57) ABSTRACT

A foundation pile comprising a longitudinal through hole (1) and a plurality of crosswise through holes (2) transverse to longitudinal through hole (1) extending between longitudinal through hole (1) and the outer surface of the pile and optionally further comprising check valves positioned in the crosswise through holes (2), configured such that the crosswise through holes (2) and the check valves allow one-way
(Continued)

communication from the inside of the pile to the outside of the pile from longitudinal through hole (1) to the outer side surfaces of the pile.

6 Claims, 3 Drawing Sheets

(51) Int. Cl.
*E02D 7/00* (2006.01)
*E02D 5/24* (2006.01)
*E02D 5/62* (2006.01)

(52) U.S. Cl.
CPC ..... *E02D 7/00* (2013.01); *E02D 2250/0023* (2013.01); *E02D 2300/002* (2013.01)

(56) References Cited

U.S. PATENT DOCUMENTS 1,435,144 A * 11/1922 Bignell ..... E02D 5/32
405/248
1,529,112 A * 3/1925 Burns ..... E02D 5/32
405/248
1,529,113 A * 3/1925 Burns ..... E02D 5/32
175/324
1,574,439 A * 2/1926 Pringle ..... E02D 5/32
405/248
1,831,209 A * 11/1931 Thornley et al. ..... E02D 5/385
405/243
2,065,507 A * 12/1936 Alexander ..... E02D 5/523
405/252
3,064,438 A * 11/1962 Müller ..... E02D 5/30
405/236
3,200,599 A * 8/1965 Phares et al. ..... E02D 5/62
405/241
3,243,962 A 4/1966 Ratliff
3,939,664 A 2/1976 Mazier et al.
6,821,056 B1 * 11/2004 Mansour ..... E02D 27/48
405/230
2005/0120813 A1 6/2005 Clark et al.

OTHER PUBLICATIONS

Spanish Search Report for Spanish Application No. 201530091, dated May 11, 2016.
German Office Action issued in corresponding German Patent Application No. 16 708 429.2 dated Jun. 24, 2020.

* cited by examiner

FOUNDATION PILE, A GROUTING METHOD FOR THE SAID PILE AND A MANUFACTURING METHOD THEREFOR

FIELD OF THE INVENTION

This invention relates to a precast concrete pile for deep foundations by pile driving. Thus, the invention falls in the technical field of building and construction.

BACKGROUND OF THE INVENTION

Precast prestressed concrete piles having a continuous axial through hole along their entire length driven in sections ordinarily less than 14 m in length (the maximum length transportable by conventional means) connected together by hollow couplings are known. This method of pile driving enables piles to be installed tens of metres deep and certain elements such as steel piping, cable anchors, grouting pipes, and geothermal probes to be inserted through the axial hollow core.

Various grouting systems, sleeve grouting (IU), unitary and global grouting (IGU), repetitive grouting (IR), and repetitive and selective grouting (IRS), are also known in the field of micropiles and ground anchors.

However, these earlier piles and known grouting systems do not allow access to the lateral surfaces of prefabricated piles once they have been driven in, nor do they allow grouting of the said lateral surfaces by any of the known grouting systems described above when used with other geotechnical methods (micropiles, anchors).

DESCRIPTION OF THE INVENTION

One of the objects of this invention is a foundation pile that comprises a longitudinal through hole, characterized in that it comprises a plurality of crosswise through holes transverse to the longitudinal hole, which through holes extend outwards between the said longitudinal hole and the outer surface of the pile. These holes thereby allow cement grouts and mortars to be injected through the pile shaft by means of the different grouting systems, namely, sleeve grouting (IU), unitary and global grouting (IGU), repetitive grouting (IR), and repetitive and selective grouting (IRS).

This design affords the capability of injecting mortars and cement grouts through the shaft of the pile by means of the various grouting systems, i.e., sleeve grouting (IU), unitary and global grouting (IGU), repetitive grouting (IR), and repetitive and selective grouting (IRS), making it possible to considerably augment the lateral strength of the pile and thereby increase the overall load-bearing capacity of the pile.

In addition, it may comprise at the crosswise holes check valves to set up one-way communication from the inside of the pile to the outside of the pile from the longitudinal hole running through the pile to the outer side surfaces of the pile.

As already mentioned the pile may also be a precast pile capable of being connected together by hollow couplings.

Another object of the invention is a method of grouting foundation piles characterized in that the material to be injected, for example, a grout, is injected through the longitudinal through hole, with the grouting material so injected subsequently expanding through a plurality of crosswise through holes transverse to the longitudinal through hole and extending from the said longitudinal through hole to the outer surface of the pile, whereby the injected grouting material spreads through the crosswise through holes from the shaft of the pile.

Both the pile of the invention and the grouting method serve to increase the lateral strength of the precast concrete pile of the invention, thereby augmenting the overall strength of the pile as a whole.

Lastly, another object of the invention is a method of manufacturing foundation piles characterized in that it comprises the following steps:

- Placing a lengthwise tube in position,
- Placing a plurality of crosswise tubes in position transverse to the longitudinal tube, whereby the longitudinal tube and the crosswise tubes are in communication, and
- Casting concrete around the longitudinal tube and the plurality of crosswise tubes such that the crosswise tubes extend through to the outer surface of the concrete.

Additionally in case that the pile comprises check valves, before the concrete casting step, said check valves are included in the crosswise tubes (2).

DESCRIPTION OF THE DRAWINGS

Drawings are provided for a better understanding of the invention and to complement the description. Said drawings are an integral part of the description and illustrates an exemplary embodiment of the invention.

DETAILED DESCRIPTION OF THE INVENTION

The figures illustrate an embodiment of the invention consisting of a pile divided into longitudinal sections that can be coupled together. The pile comprises a longitudinal through hole (1) and a plurality of crosswise through holes (2) transverse to the longitudinal hole (1) extending between the longitudinal through hole (1) and the outer surface of the pile. Crosswise through holes (2) further comprise check valves configured such that through holes (2) and the check valves permit one-way communication from the inside of the pile to the outside of the pile from longitudinal through hole (1) outwards to the outer side surfaces of the pile.

More specifically, to achieve uniform distribution of the grout (3) and to offset the reaction forces on injecting the grout within a cross-section of the pile, the pile comprises individual crosswise through holes (20, 21) arranged so that they oppose each other. To further improve the said enhanced distribution of the grout (3), the embodiment shown in the figures comprises four holes (20, 21, 22, 23), in two pairs of opposing holes.

Figure 1:
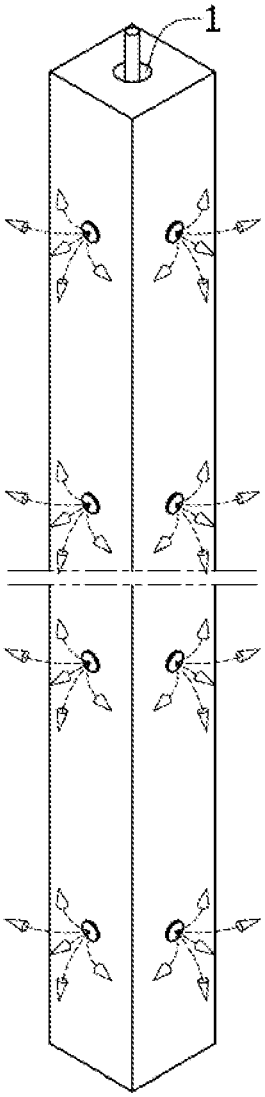
FIG. 1 is a perspective view of a pile manufactured according to an embodiment of the invention.
Figure 2:
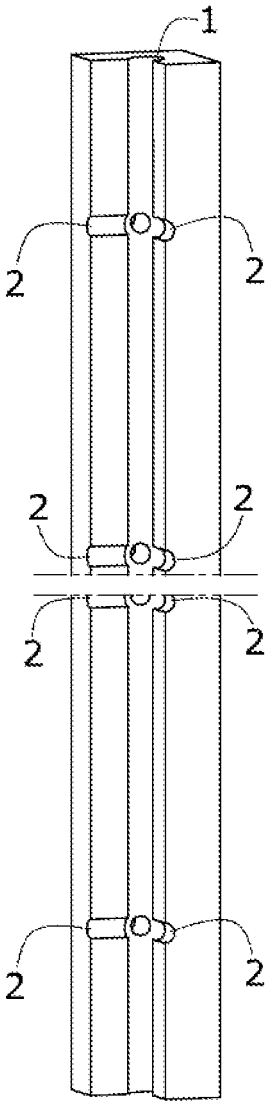
FIG. 2 is a longitudinal section of the pile according to the embodiment shown in FIG. 1.
Figure 3:
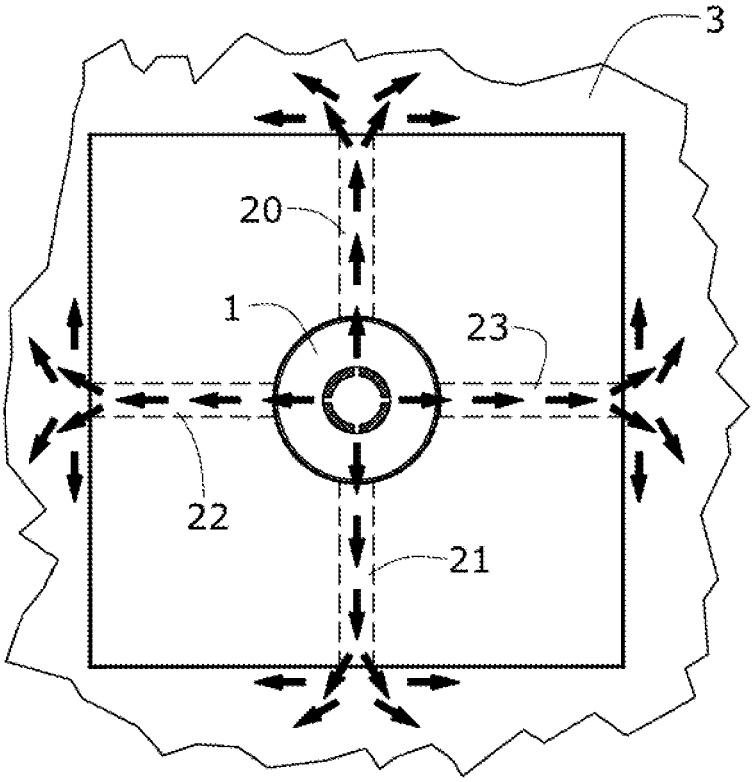
FIG. 3 is a detailed view of a cross-section of the embodiment of the pile according to FIGS. 1 and 2 on grouting the pile shaft using one of the different grout injection systems [sleeve grouting (IU), unitary and global grouting (IGU), repetitive grouting (IR), and repetitive and selective grouting (IRS)].
Figure 4:
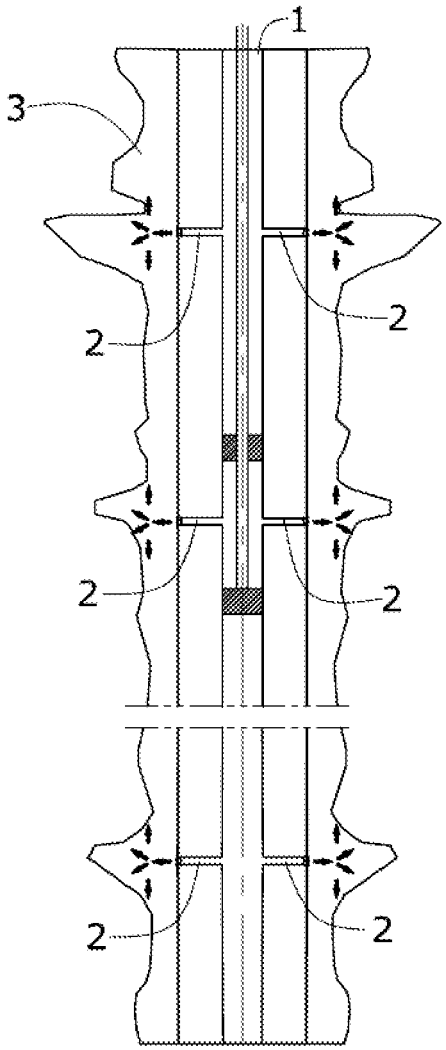
FIG. 4 is a view similar to that in FIG. 3 but of a longitudinal section of the pile.

This is clearly depicted in FIG. 4, which represents an embodiment of insertion of the grout (3) during injection through the shaft of the pile, such that the grout (3) fills the shaft, thereby enhancing its load-bearing capacity.

The invention claimed is:

1. A driven foundation pile configured to be driven in soil by displacing the soil, the driven pile comprising:

a shaft made of precast concrete;

a longitudinal through hole formed through the shaft, the longitudinal through hole being a continuous axial through hole through an entire length of the pile; and a plurality of crosswise through holes formed through the shaft, each of the crosswise through holes oriented transverse to the longitudinal through hole and extending between the longitudinal through hole and an outer surface of the shaft, the crosswise through holes being configured to allow cement grouts and mortar to be injected flush with the outer surface of the shaft from the plurality of crosswise through holes to grout between the lateral surface of the pile and the surrounding displaced soil, wherein the pile is configured to regulate grout and mortar emanating from the crosswise through holes before, during, and after a driving operation, the longitudinal through hole being configured to allow the cement grouts and mortar to flow out of both ends of the longitudinal through hole when the cement grouts and mortar are injected to grout the lateral surface of the pile, wherein the crosswise through holes comprise check valves configured such that the crosswise through holes and the check valves allow one-way communication from the inside of the pile to the outside of the pile from the longitudinal through hole to the outer side surfaces of the shaft.

2. The foundation pile according to claim 1, wherein the crosswise through holes are grouped in a plurality of cross-sections, each one of the cross-sections being transverse to the longitudinal through hole, each one of the cross-sections comprising a group of the crosswise through holes arranged in different directions.

3. The foundation pile according to claim 2, wherein for each cross-section, the group of crosswise through holes comprises four crosswise through holes in which each crosswise through hole in the group is arranged in a direction that differs from that of the other crosswise through holes in the group.

4. The foundation pile according to claim 1, wherein the pile is divided longitudinally into sections that can be coupled together.

5. A method of grouting a driven foundation pile configured to be driven in soil by displacing the soil, the driven pile having a shaft made of precast concrete, the method comprising:

sinking the pile by pile driving, injecting a grouting material through a longitudinal through hole in the shaft and the grouting material subsequently expands through a plurality of crosswise through holes, the crosswise through holes transverse to the longitudinal through hole and extending between the longitudinal through hole and an outer surface of the shaft, such that the grouting material spreads from the shaft through the crosswise through holes, the crosswise through holes allowing the grouting material to be injected flush with the outer surface of the shaft from the plurality of crosswise through holes to grout between the lateral surface of the pile and the surrounding displaced soil, wherein the pile is configured to regulate grout and mortar emanating from the crosswise through holes before, during, and after a driving operation, the longitudinal through hole being a continuous axial through hole through an entire length of the pile, the longitudinal through hole allowing the cement grouts and mortar to flow out of both ends of the longitudinal through hole when the cement grouts and mortar are injected to grout the lateral surface of the pile, wherein the crosswise through holes comprise check valves configured such that the crosswise through holes and the check valves allow one-way communication from the inside of the pile to the outside of the pile from the longitudinal through hole to the outer side surfaces of the shaft.

6. A method of manufacturing a driven foundation pile made of precast concrete configured to be driven in soil by displacing the soil, the method comprising the following steps:

placing a longitudinal tube in position, the longitudinal tube being a continuous axial tube through an entire length of the pile, placing a plurality of crosswise tubes in position transverse to the longitudinal tube, whereby the longitudinal tube and the crosswise tubes are in communication, the crosswise tubes being configured to allow cement grouts and mortar to be injected flush with the outer surface of the shaft from the plurality of crosswise through holes to grout between the lateral surface of the driven pile and the surrounding displaced soil, wherein the pile is configured to regulate grout and mortar emanating from the crosswise through holes before, during, and after a driving operation, the longitudinal tube being configured to allow the cement grouts and mortar to flow out of both ends of the longitudinal tube when the cement grouts and mortar are injected to grout the lateral surface of the pile, and forming a shaft of precast concrete by casting concrete around the longitudinal tube and the plurality of crosswise tubes such that the crosswise tubes extend through the concrete to the outer surface of the concrete, wherein check valves are included in the crosswise tubes before the concrete casting step.

* * * * *